US010914277B2

(12) United States Patent
Hariu et al.

(10) Patent No.: US 10,914,277 B2
(45) Date of Patent: Feb. 9, 2021

(54) INTAKE DEVICE FOR SADDLE RIDING VEHICLE

(71) Applicant: HONDA MOTOR CO., LTD., Tokyo (JP)

(72) Inventors: Jun Hariu, Asaka (JP); Akiyuki Karashima, Asaka (JP); Takuya Nakano, Asaka (JP)

(73) Assignee: HONDA MOTOR CO., LTD., Tokyo (JP)

( * ) Notice: Subject to any disclaimer, the term of this patent is extended or adjusted under 35 U.S.C. 154(b) by 121 days.

(21) Appl. No.: 16/241,222

(22) Filed: Jan. 7, 2019

(65) Prior Publication Data

US 2019/0242336 A1 Aug. 8, 2019

(30) Foreign Application Priority Data

Feb. 5, 2018 (JP) ..... 2018-018615

(51) Int. Cl.

| | |
|---|---|
| ***F02M 35/024*** | (2006.01) |
| ***F02M 35/10*** | (2006.01) |
| ***F02M 35/04*** | (2006.01) |
| ***F02M 35/16*** | (2006.01) |
| *F02B 61/02* | (2006.01) |

(52) U.S. Cl.

CPC .... *F02M 35/10216* (2013.01); *F02M 35/024* (2013.01); *F02M 35/042* (2013.01); *F02M 35/162* (2013.01); *F02B 61/02* (2013.01)

(58) Field of Classification Search

CPC ..... F02M 35/10216; F02M 35/024; F02M 35/042; F02M 35/162; F02B 61/02

USPC ..... 180/68.3

See application file for complete search history.

(56) References Cited

U.S. PATENT DOCUMENTS 4,509,613 A * 4/1985 Yamaguchi ..... B62J 35/00 180/219
5,368,621 A 11/1994 Pool
6,251,151 B1 * 6/2001 Kobayashi ..... F02B 61/02 123/198 E (Continued)

FOREIGN PATENT DOCUMENTS

EP 2617982 A1 * 7/2013 ..... F02M 63/0275
JP 59-141150 9/1984

(Continued)

OTHER PUBLICATIONS

Japanese Office Action dated Sep. 3, 2019, English translation included, 12 pages.

(Continued)

*Primary Examiner* — James A Shriver, II
*Assistant Examiner* — Hilary L Johns
(74) *Attorney, Agent, or Firm* — Rankin, Hill & Clark LLP

(57) ABSTRACT

In an intake device, an upper fuel injection device that injects a fuel and a suction port that suctions the air-fuel mixture supplied to a cylinder head are disposed in the air cleaner. The intake device includes the air cleaner including an air cleaner case and a sidewall filter that purifies an air suctioned into the air cleaner case. The sidewall filter partitions a space in the air cleaner case in a vehicle width direction, and has at least partially overlapping with the upper fuel injection device in the vehicle width direction.

16 Claims, 11 Drawing Sheets

(56) References Cited

U.S. PATENT DOCUMENTS 6,355,077 B1 * 3/2002 Chittenden ..... B01D 46/2414 55/385.3
6,478,105 B2 * 11/2002 Okuma ..... F02B 61/02 180/219
6,736,871 B1 * 5/2004 Green ..... B01D 46/0036 55/385.3
6,840,973 B2 * 1/2005 Kuji ..... B01D 39/1676 55/385.3
2001/0025471 A1 * 10/2001 Fries ..... B01D 46/106 55/320
2001/0050193 A1 * 12/2001 Yoshida ..... F01M 13/04 180/219
2002/0100262 A1 * 8/2002 Gieseke ..... B01D 46/527 55/385.3
2011/0011373 A1 * 1/2011 Shimura ..... F02M 37/0029 123/497
2013/0306044 A1 * 11/2013 Tanaka ..... F02M 35/0207 123/573
2014/0318499 A1 * 10/2014 Tanaka ..... F02D 11/10 123/478
2015/0275833 A1 * 10/2015 Arima ..... F02B 39/00 123/559.1

FOREIGN PATENT DOCUMENTS

| | | |
|---|---|---|
| JP | 2002-211463 | 7/2002 |
| JP | 2003-286916 | 10/2003 |
| JP | 2005-146931 | 6/2005 |
| JP | 2005-220831 | 8/2005 |
| JP | 2008-151150 | 7/2008 |
| JP | 2016-088424 | 5/2016 |

OTHER PUBLICATIONS

Japanese Office Action with English translation dated Mar. 24, 2020, 11 pages.

* cited by examiner

INTAKE DEVICE FOR SADDLE RIDING VEHICLE

INCORPORATION BY REFERENCE

The present application claims priority under 35 U.S.C.§ 119 to Japanese Patent Application No. 2018-018615 filed on Feb. 5, 2018. The content of the application is incorporated herein by reference in its entirety.

TECHNICAL FIELD

The present invention relates to an intake device for a saddle riding vehicle.

BACKGROUND ART

Conventionally, it has been known an air cleaner internally includes a filter, and a part of the filter has a cut-out portion where a fuel injection device is housed (for example, see Patent Literature 1).

CITATION LIST

Patent Literature

[Patent Literature 1] JP-A No. 2016-88424

SUMMARY OF INVENTION

Technical Problem

In Patent Literature 1, while the filter having the cut-out portion ensures a compact air cleaner, a narrow space around the fuel injection device causes a non-smooth formation of an air-fuel mixture; therefore, an improvement to enhance an intake quantity of the air-fuel mixture suctioned into an engine has been demanded.

The object of the present invention is to provide an intake device for a saddle riding vehicle that ensures, in addition to downsizing an air cleaner, further smoothly forming an air-fuel mixture and yet ensures securing an intake quantity of an air-fuel mixture to an engine.

Solution to Problem

According to an aspect of a first aspect of the present invention, there is provided an intake device for a saddle riding vehicle in which a fuel injection device (41) that injects a fuel and a suction port (27*a*) that suctions an air-fuel mixture supplied to a cylinder head (22*b*) are disposed in an air cleaner (25). The air cleaner (25) includes an air cleaner case (75) and a filter (105) that purifies an air suctioned into the air cleaner case (75). In the intake device for the saddle riding vehicle, the filter (105) partitions a space in the air cleaner case (75) in a vehicle width direction, and has at least partially overlapping with the fuel injection device (41) in the vehicle width direction.

In a second aspect of the above-described invention, the filter (105) may be disposed on right and left sides of the fuel injection device (41).

In a third aspect of the above-described invention, the filter (105) may be disposed in a range equal to or more than a length of the fuel injection device (41) in a vehicle front-rear direction.

In a fourth aspect of the above-described invention, the filter (105) may be disposed in a range equal to or more than a distance from the suction port (27*a*) to an injection hole of the fuel injection device (41) in the vehicle front-rear direction.

In a fifth aspect of the above-described invention, the filter (105) may be inclinedly disposed such that an upper end is located at an inner side in the vehicle width direction with respect to a lower end.

In a sixth aspect of the above-described invention, to the air cleaner case (75), a duct (26) that guides an air into the air cleaner (25) may be coupled, and the filter (105) may be disposed to face a suction port (73*a*) of the air cleaner case (75) to which the duct (26) is coupled.

In in a seventh aspect of the above-described invention, the suction port (73*a*) of the air cleaner case (75), the filter (105), and the fuel injection device (41) each may have at least partially overlapping in the vehicle width direction.

In an eighth aspect of the above-described invention, the filter (105) may be disposed at right and left sides of the fuel injection device (41), and the air cleaner case (75) may have an upper wall (73*e*) on which a recess (73*f*) may be disposed at an inner side in the vehicle width direction with respect to a right and left pair of the filters (105).

In a ninth aspect of the above-described invention, the filter (105) is held by a filter holding member (78) that may have a filter side recess (78*k*) formed into a shape that runs along the recess (73*f*) of the air cleaner case (75).

Advantageous Effects of Invention

The filter in the first aspect of the present invention partitions the space in the air cleaner case in the vehicle width direction, and has at least partially overlapping with the fuel injection device in the vehicle width direction, thereby ensuring widely forming an upper space of the fuel injection device compared with a conventional configuration in which the filter is disposed in an upper side of the fuel injection device so as to divide the space in the air cleaner into an upper side and a lower side. This ensures stably securing an air-intake quantity of the air-fuel mixture to the cylinder head and ensures disposing the filter at the proximity of the fuel injection device. In view of this, the air-fuel mixture flow of the fuel injected from the fuel injection device and the air can be smoothly formed and the air cleaner case can be downsized.

In the second aspect of the above-described invention, the filter is disposed on the right and left sides of the fuel injection device, and therefore, the air can be equally suctioned from the right and left filters, thereby ensuring further stably securing the air-intake quantity of the air-fuel mixture into the cylinder head.

In the third aspect of the above-described invention, the filter is disposed in the range equal to or more than the length of the fuel injection device in the vehicle front-rear direction, and therefore, the intake air from the filter can be smoothly supplied to the proximity of the fuel injection device, thereby further smoothly forming the air-fuel mixture flow of the fuel injected from the fuel injection device and the intake air.

In the fourth aspect of the above-described invention, the filter is disposed in the range equal to or more than the distance from the suction port to the injection hole of the fuel injection device in the vehicle front-rear direction, and therefore, the intake air from the filter can be smoothly supplied to the proximity of the fuel injection device, thereby further smoothly forming the air-fuel mixture flow of the fuel injected from the fuel injection device and the intake air.

In the fifth aspect of the above-described invention, the filter is inclinedly disposed such that the upper end is located at the inner side in the vehicle width direction with respect to the lower end, and therefore, the intake air from the filter can be smoothly supplied to the proximity of the fuel injection device, thereby further smoothly forming the air-fuel mixture flow of the fuel injected from the fuel injection device and the intake air.

In the sixth aspect of the above-described invention, to the air cleaner case, the duct that guides an air into the air cleaner is coupled, and the filter is disposed to face the suction port of the air cleaner case to which the duct is coupled, thereby ensuring smoothly supplying the intake air from the duct to the cylinder head via the filter.

In the seventh aspect of the above-described invention, the suction port of the air cleaner case, the filter, and the fuel injection device each have at least partially overlapping in the vehicle width direction, and therefore, the air taken into the air cleaner case from the duct easily mix with the fuel injected from the fuel injection device, thereby ensuring smoothly supplying the produced air-fuel mixture to the cylinder head.

In the eight aspect of the above-described invention, the filter is disposed at the right and left sides of the fuel injection device, and the air cleaner case has the upper wall on which the recess is disposed at the inner side in the vehicle width direction with respect to the right and left pair of filters, thereby ensuring a reduced air resistance during travelling, for example, by an occupant putting his/her head in the recess during travelling, without narrowing the upper space of the fuel injection device compared with a conventional configuration in which the filter is disposed in the upper side of the fuel injection device so as to divide the air cleaner into an upper side and a lower side.

In the ninth aspect of the above-described invention, the filter is held by the filter holding member that has the filter side recess formed into the shape that runs along the recess of the air cleaner case, thereby ensuring forming a wide space in the air cleaner case by forming the filter side recess into the shape running along the recess of the air cleaner case. Furthermore, causing the filter side recess to abut on or be adjacent to the recess of the air cleaner case ensures contributions to an improved strength and a reduced vibration of the upper portion of the air cleaner case.

DESCRIPTION OF EMBODIMENT

Figure 1:
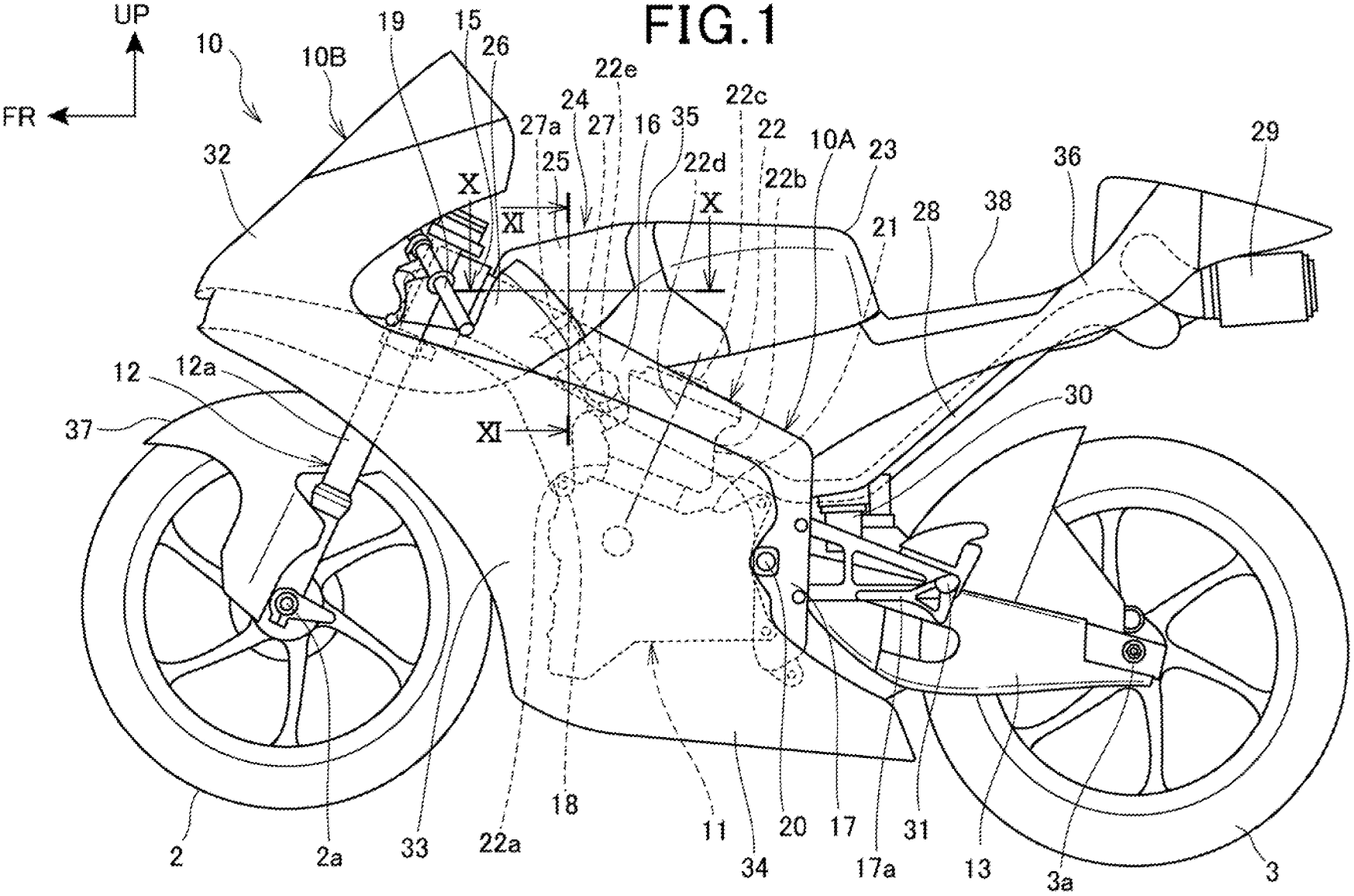
FIG. 1 is a left side view illustrating a motorcycle including an intake device according to the present invention.

The following describes one embodiment of the present invention with reference to the drawings. It is to be noted that, throughout the explanation, descriptions of directions, such as front, rear, right, left, up, and down, are identical to directions with respect to a vehicle body, unless otherwise stated. In each drawing, reference numeral FR denotes a front side of the vehicle body, reference numeral UP denotes an upper side of the vehicle body, and reference numeral LH denotes a left side of the vehicle body.

FIG. 1 is a left side view illustrating a motorcycle 10 including an intake device 24 according to the present invention.

The motorcycle 10 includes a body frame 10A. The body frame 10A has a center portion in which an engine 11 is disposed. The body frame 10A has a front end portion where a front fork 12 is steerably supported. The body frame 10A has a lower portion where a swing arm 13 is supported swingable up and down. The front fork 12 has a lower portion where a front wheel 2 is supported. The swing arm 13 has a rear end portion where a rear wheel 3 is supported.

The motorcycle 10 is a saddle riding vehicle including a seat 38 on which an occupant seats. The seat 38 is disposed on an upper portion of the body frame 10A.

A significant portion of the body frame 10A and the engine 11 is covered with a vehicle body cover 10B made of resin.

The body frame 10A includes a head tube 15, a right and left pair of main frames 16, a right and left pair of pivot frames 17, a right and left pair of seat frames (not illustrated), a right and left pair of down frames 18.

The head tube 15 is disposed at the front end portion of the body frame 10A. The right and left main frames 16 inclinedly extend obliquely downward to the rear from the head tube 15. The right and left pivot frames 17 extend downward from a rear end of the right and left main frames 16. The right and left seat frames extend upward to the rear up to the rear portion of the vehicle from upper portions of the right and left pivot frames 17. The right and left down frames 18 extend obliquely downward to the rear from lower portions of the right and left main frames 16, and are disposed at front and obliquely upper sides of the engine 11 in side view.

The head tube 15 turnably supports the front fork 12 via a steering shaft (not illustrated). The front wheel 2 is supported at respective lower portions of right and left pair of fork pipes 12*a*, which constitute the front fork 12, via an axle shaft 2*a*. The front fork 12 has an upper end portion where a handlebar 19 for steering is secured.

A pivot shaft 20 is inserted through the right and left pivot frames 17 in a vehicle width direction and secured. The swing arm 13 is swingably supported by the pivot shaft 20. The rear wheel 3 is supported by the rear end portion of the swing arm 13 via an axle shaft 3*a*.

The engine 11 is a four-stroke engine with a single cylinder. The engine 11 includes a crankcase 21 and a cylinder portion 22 extending upward from an upper surface on a front portion of the crankcase 21.

The cylinder portion 22 includes a cylinder block 22*a* combined to an upper surface of the crankcase 21, a cylinder head 22*b* combined to the cylinder block 22*a*, and a cylinder head cover 22*c* covering an upper portion of the cylinder head 22*b*.

The cylinder portion 22 tilts rearward, and an axis 22*d* of the cylinder portion 22 also tilts rearward.

The engine 11 is supported by front upper portions and front lower portions of the right and left pivot frames 17 and distal end portions of the right and left down frames 18. The crankcase 21 is positioned below the right and left main frames 16 and ahead of the right and left pivot frames 17.

The cylinder head 22*b* overlaps rear portions of the right and left main frames 16 in side view.

A fuel tank 23 is disposed ahead of the seat 38 and above the rear portions of the right and left main frames 16, and above the right and left pivot frames 17.

Between the head tube 15 and the fuel tank 23, the intake device 24 that supplies an air to the engine 11 is disposed.

The intake device 24 includes an air cleaner 25, a right and left pair of ducts 26, and a throttle body 27.

The air cleaner 25 is disposed between the head tube 15 and the fuel tank 23 ahead of the fuel tank 23. The air cleaner 25 purifies the air. The right and left ducts 26 extend rearward from a front surface of the motorcycle 10 to be coupled to the air cleaner 25. The throttle body 27 is coupled to an air intake opening 22*e* on a front surface of the cylinder head 22*b*. The throttle body 27 has a front end portion where an air suction port 27*a* is disposed.

The cylinder head 22*b* has a rear surface with an exhaust outlet (not illustrated) to which an exhaust pipe 28 is coupled. The exhaust pipe 28 extends rearward passing below the seat 38 to be coupled to a muffler 29 disposed above the rear wheel 3. That is, the engine 11 is, what is called a rear exhaust type, which takes in an air from the front surface of the cylinder head 22*b* and exhausts the air from the rear surface of the cylinder head 22*b*.

Between the swing arm 13 and the body frame 10A, a rear cushion unit 30 is bridged.

A right and left pair of stays 17*a* that extend rearward from the right and left respective pivot frames 17 include a right and left pair of respective steps 31 on which a rider puts his feet.

The vehicle body cover 10B includes a front cowl 32, a right and left pair of center side covers 33, an undercover 34, an upper cover 35, and a rear cover 36.

The front cowl 32 covers an upper portion of the head tube 15 and the front fork 12 from a front. The right and left center side covers 33 covers the engine 11 from sides. The undercover 34 covers the engine 11 from a lower side. The upper cover 35 covers between the air cleaner 25 and the fuel tank 23. The rear cover 36 covers the rear portion of the body frame 10A.

The front wheel 2 is covered with a front fender 37 from an upper side. The front fender 37 is secured to the front fork 12.

Figure 2:
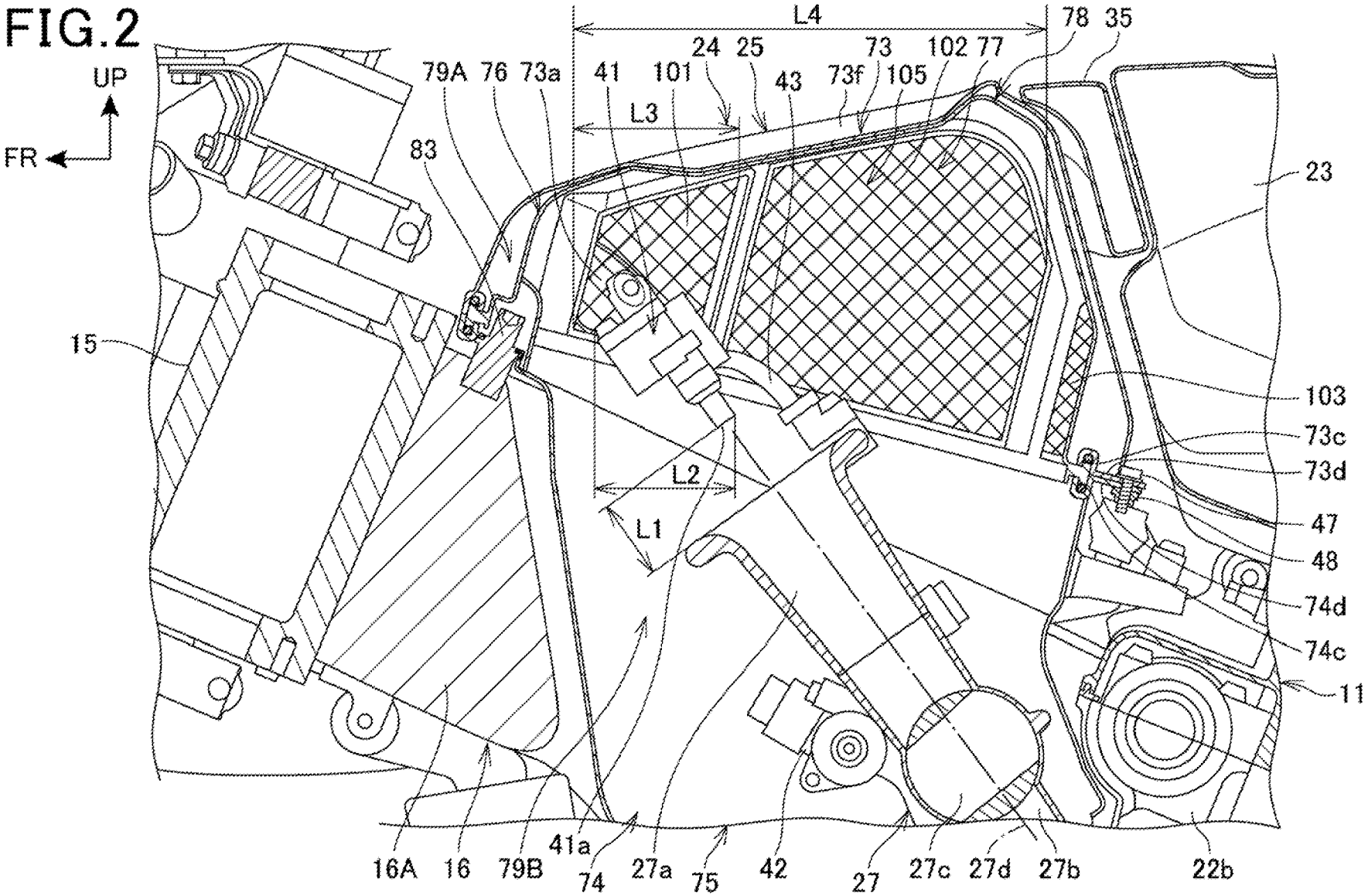
FIG. 2 is a cross-sectional view illustrating the intake device and a peripheral area of the intake device.

FIG. 2 is a cross-sectional view illustrating the intake device 24 and a peripheral area of the intake device 24, and illustrates a cross-sectional surface of a front upper portion of the motorcycle 10 (see FIG. 1) cut along a vertical plane passing through a center in the vehicle width direction. In order that shapes are easily comprehended, each of the filters illustrated in the drawing are crosshatched.

The air cleaner 25 includes an air cleaner case 75, which is divided into an upper side and a lower side, made of an upper case 73 and a lower case 74.

Inside the upper case 73, there is disposed a filter element 76 secured to a coupling portion between the upper case 73 and the lower case 74.

The filter element 76 configures a part of the air cleaner 25. The filter element 76 is configured of a filter main body 77 made of a plurality of filters that remove dirt, dust, and the like in an air to purify the air, and a filter supporting member 78 that holds the filter main body 77.

The filter element 76 is formed into a shape along an inner surface of the upper case 73. A space between the upper case 73 and the filter element 76 is a dirty side 79A. A space between an inner side of the filter element 76 and an inner side of the lower case 74 is a clean side 79B.

In the clean side 79B, the throttle body 27 is disposed on a side of the lower case 74, and an upper fuel injection device 41 is disposed to straddle over the upper case 73 side and the lower case 74 side. The upper fuel injection device 41 has a distal end portion 41*a* at which an injection hole (not illustrated) that injects a fuel is disposed.

The throttle body 27 includes a cylindrically-shaped air passage 27*b* and a rotary throttle valve 27*c* disposed in the middle of the air passage 27*b*.

The air passage 27*b* has a front side where a lower fuel injection device 42 that injects the fuel into the air passage 27*b* is mounted. A stay 43 is mounted on the air suction port 27*a*. The stay 43 has a distal end portion at which the upper fuel injection device 41 is mounted.

The upper fuel injection device 41 is disposed on an extended line of an axis 27*d* of the air suction port 27*a* and the air passage 27*b* of the throttle body 27. The upper fuel injection device 41 has the distal end portion 41*a* that is away from the air suction port 27*a* by a predetermined distance L1.

The upper fuel injection device 41 overlaps a suction port 73*a* of the upper case 73 and the filter main body 77 (specifically, a front filter 101) of the filter element 76 in side view.

The upper case 73 has a lower edge portion where an upper ring groove 73*c* and a ring-shaped upper flange 73*d* that surrounds the upper ring groove 73*c* are formed. The lower case 74 has an upper edge portion where a lower ring groove 74*c* and a lower flange 74*d* that surrounds the lower ring groove 74*c* are formed. The filter element 76 has a peripheral edge portion that is inserted into the upper ring groove 73*c* and the lower ring groove 74*c*.

The upper flange 73*d* and the lower flange 74*d* are fastened with a plurality of bolts 47 and nuts 48.

The upper fuel injection device 41 has a length in a front-rear direction of L2. The front filter 101 that constitutes the filter main body 77 has a length in the front-rear direction of L3. A length from a front end of the front filter 101 to a rear end of a middle filter 102 (that constitutes the filter main body 77) arranged at rear of the front filter 101 is L4 (L4>L3). The length L3 is longer than the distance L1 (L3>L1), and greater than the length L2 (L3>L2).

As described above, (1) a sidewall filter 105 as a filter is disposed in a range equal to or more than the length L2 in the front-rear direction of the upper fuel injection device 41 in the vehicle front-rear direction.

(2) The sidewall filter 105 is disposed in a range equal to or more than the distance L1 from the air suction port 27*a* of the throttle body 27 to the injection hole (the distal end portion 41*a*) of the upper fuel injection device 41 in the vehicle front-rear direction.

With the above-described configuration (1) and (2), the intake air from the sidewall filter 105 can be smoothly supplied to the proximity of the upper fuel injection device 41, and thus, an air-fuel mixture flow of the fuel injected from the upper fuel injection device 41 and the intake air can be further smoothly formed.

Figure 3:
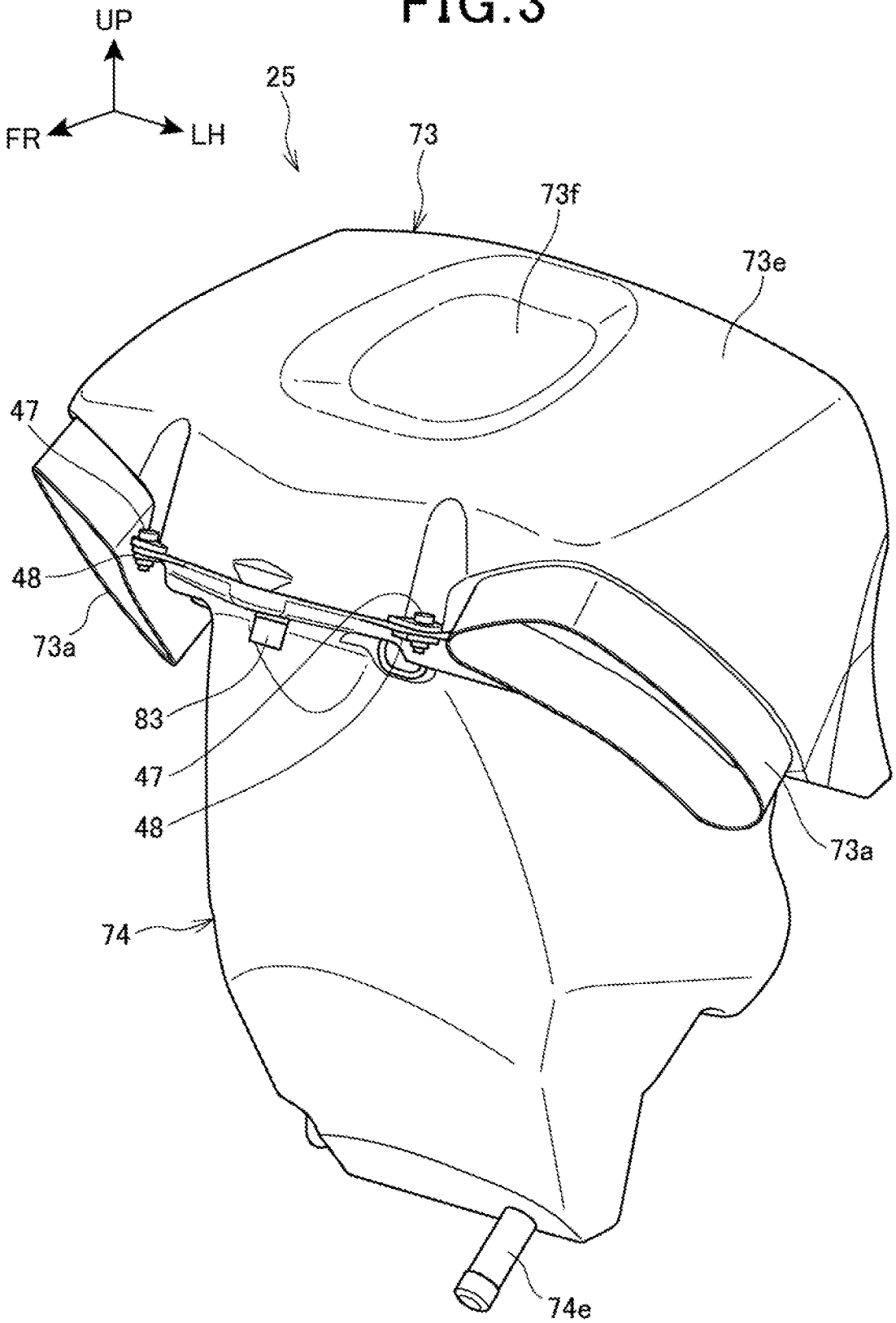
FIG. 3 is a perspective view illustrating an air cleaner.
Figure 4:
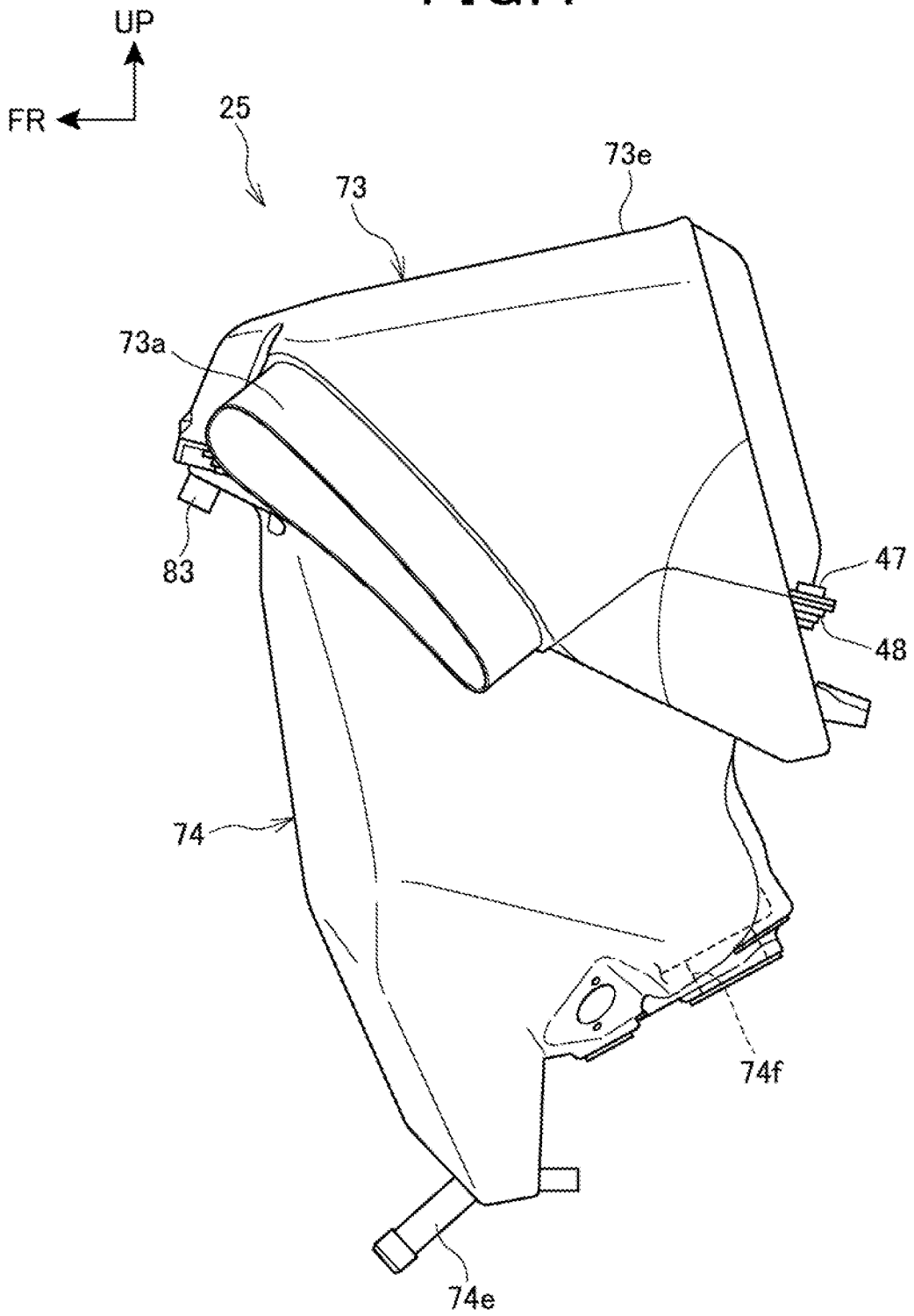
FIG. 4 is a left side view illustrating the air cleaner.
Figure 5:
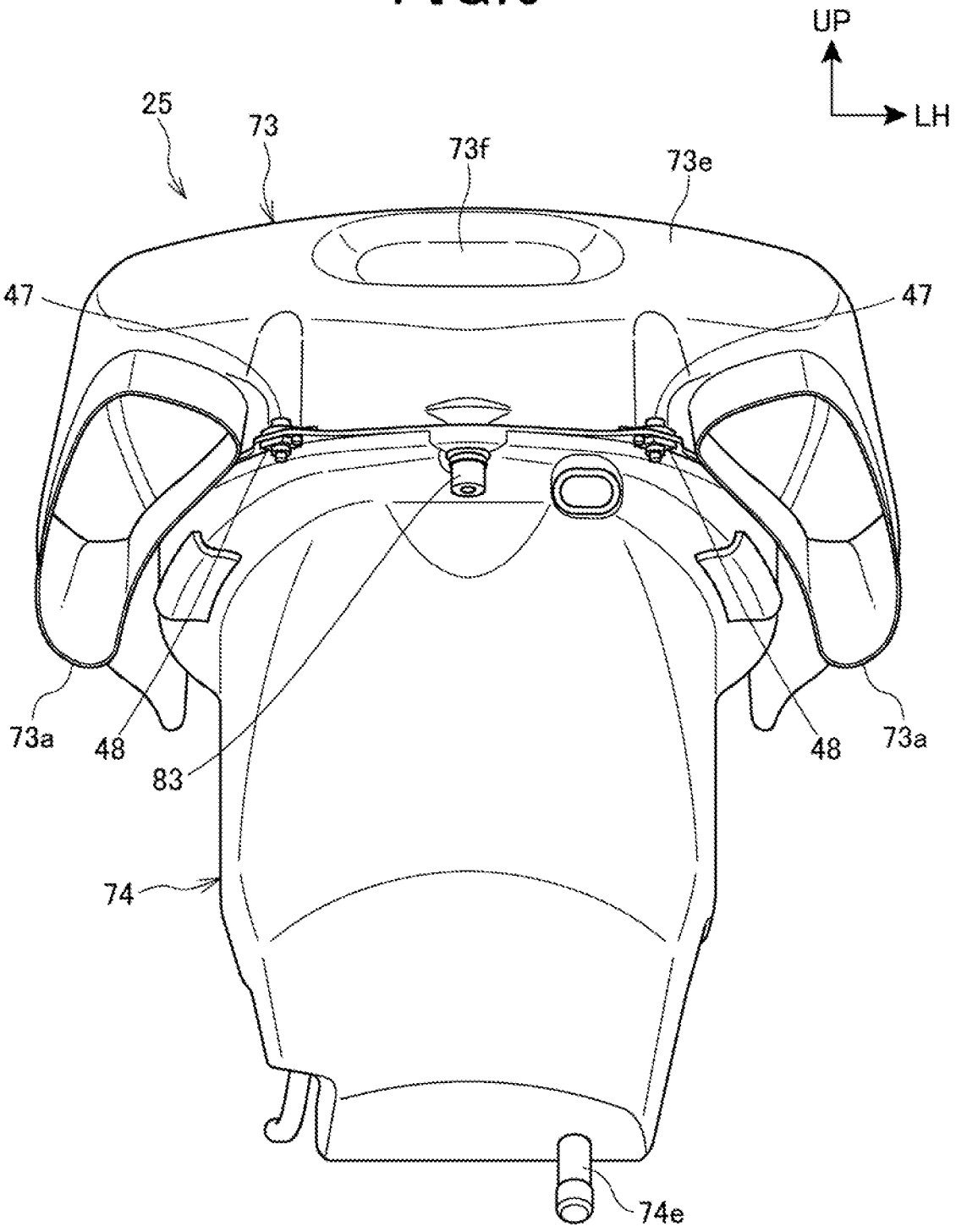
FIG. 5 is a front view illustrating the air cleaner.
Figure 6:
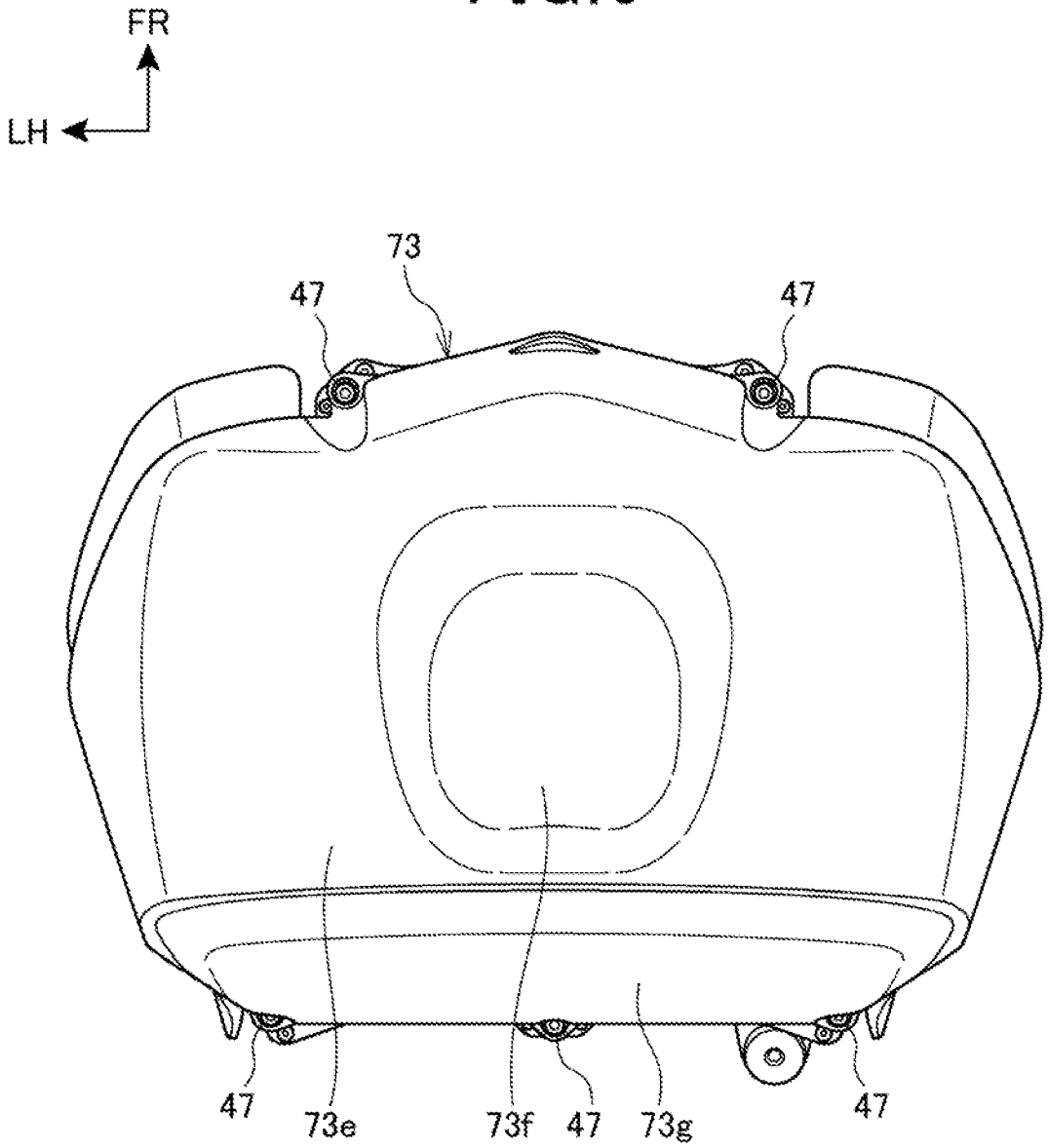
FIG. 6 is a plan view illustrating the air cleaner.

FIG. 3 is a perspective view illustrating the air cleaner 25. FIG. 4 is a left side view illustrating the air cleaner 25. FIG. 5 is a front view illustrating the air cleaner 25. FIG. 6 is a plan view illustrating the air cleaner 25.

As illustrated in FIG. 3 to FIG. 5, the upper case 73 includes a right and left pair of the suction ports 73*a* that open obliquely downward to the front on both side portions in the front portion. The upper case 73 has an upper wall 73*e* on which a recess 73*f* is formed.

The lower case 74 is formed to be vertically elongate, and has a lower end portion where a drain port 74*e* that discharges an inside water is disposed.

The lower case 74 has a forward end portion where a positioning portion 83 that is positioned at a coupling portion 16A (see FIG. 2) of the respective forward end portions of the right and left main frames 16 (see FIG. 2) is disposed. The lower case 74 has a bottom portion where an insertion hole 74*f* through which the throttle body 27 (see FIG. 2) is passed is opened.

As illustrated in FIG. 6, the recess 73*f* of the upper case 73 is formed in the center portion in the vehicle width direction on the upper wall 73*e* and near a rear wall 73*g*. The recess 73*f* is a portion where a rider puts his/her head when the rider leans his/her upper body forward while the vehicle is travelling.

Figure 7:
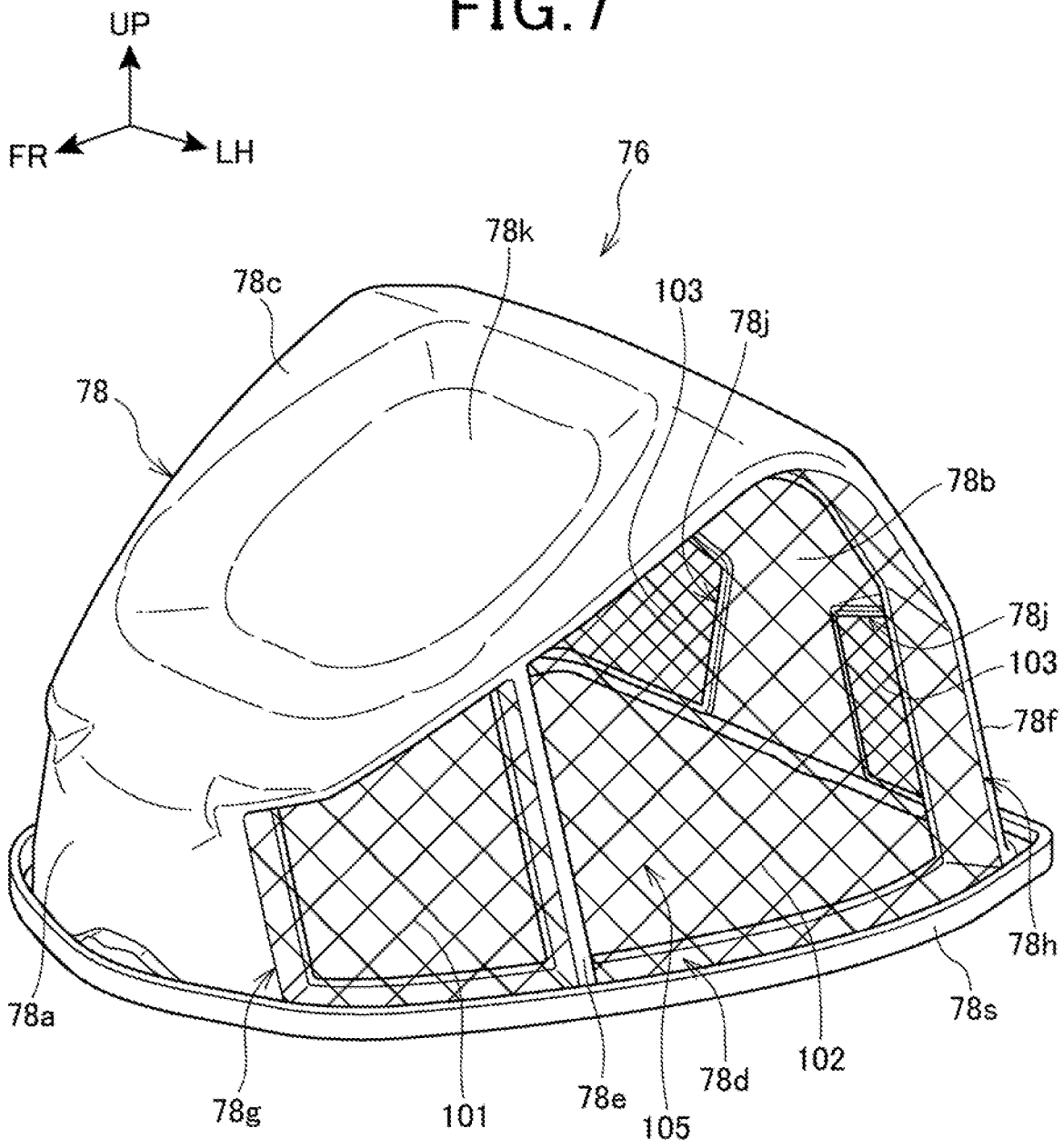
FIG. 7 is a perspective view illustrating a filter element.
Figure 8:
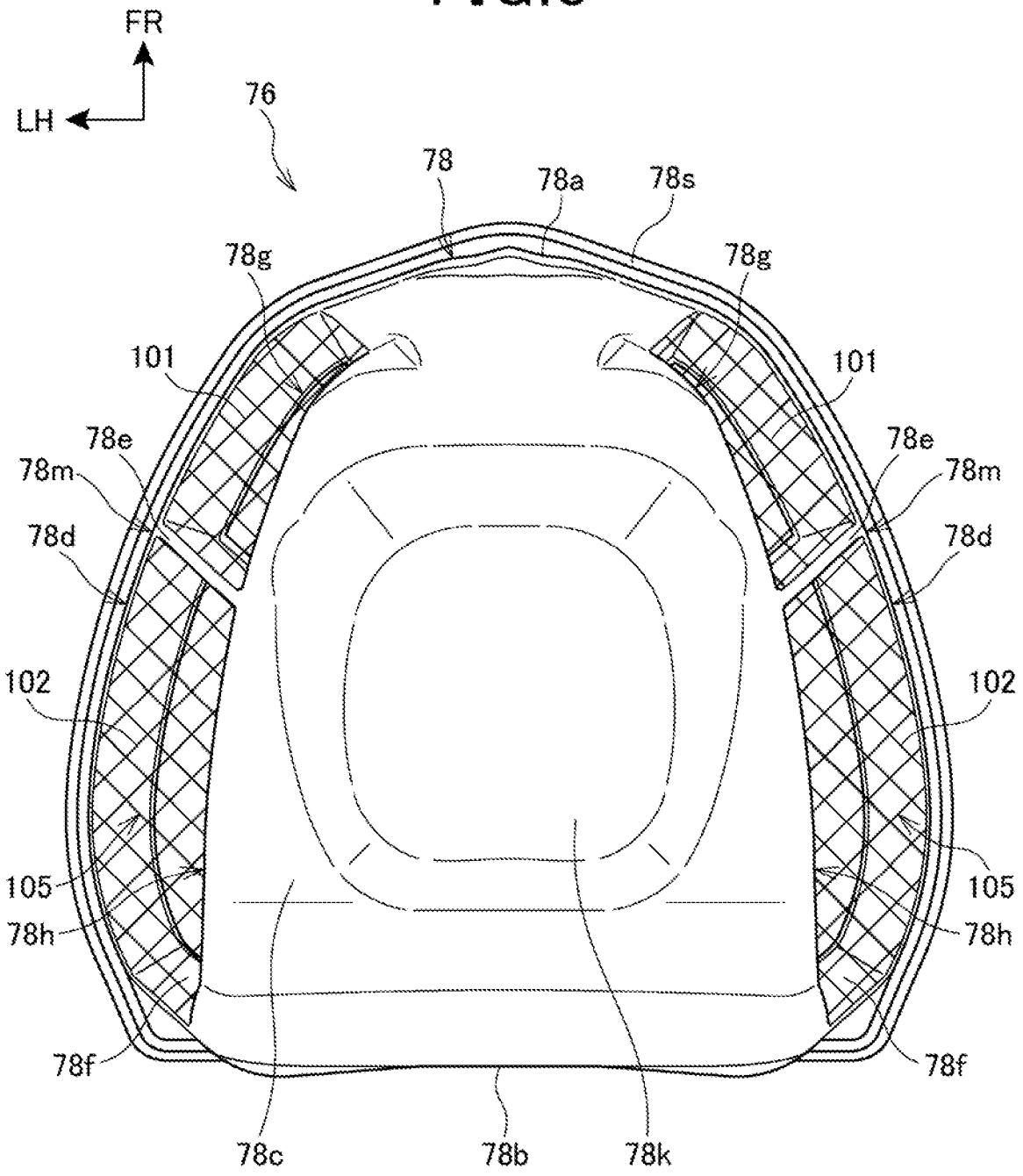
FIG. 8 is a plan view illustrating the filter element.

FIG. 7 is a perspective view illustrating the filter element 76. FIG. 8 is a plan view illustrating the filter element 76.

As illustrated in FIG. 7 and FIG. 8, the filter supporting member 78 of the filter element 76 has a front wall 78*a*, a rear wall 78*b*, a right and left pair of sidewalls 78*m*, and an upper wall 78*c*. The rear wall 78*b* and the right and left sidewalls 78*m* include a right and left pair of coupling portions 78*d*, and the right and left sidewalls 78*m* includes a right and left pair of front pillars 78*e* and a right and left pair of rear pillars 78*f*.

The upper wall 78*c* couples respective upper edges of the front wall 78*a*, the rear wall 78*b*, and the right and left sidewalls 78*m*. The right and left coupling portions 78*d* couples respective lower edges of the front wall 78*a*, the rear wall 78*b*, and the right and left sidewalls 78*m*. The right and left front pillars 78*e* and the right and left rear pillars 78*f* are bridged over the upper wall 78*c* and each of the right and left coupling portions 78*d*. The right and left rear pillars 78*f* are arranged at rear of the right and left front pillars 78*e*.

A right and left pair of front openings 78*g*, a right and left pair of middle openings 78*h*, and a right and left pair of rear openings 78*j* are formed on the rear wall 78*b* and the right and left sidewalls 78*m*. The right and left pair of front openings 78*g*, the right and left pair of middle openings 78*h*, and the right and left pair of rear openings 78*j* are fitted with a right and left pair of the front filters 101, a right and left pair of the middle filters 102, and a right and left pair of rear filters 103, respectively. The front filter 101 and the middle filter 102 constitute the sidewall filter 105 disposed on the sidewall 78*m*.

The upper wall 78*c* has a center portion on which a filter side recess 78*k* is formed. The filter side recess 78*k* is arranged inside the recess 73*f* along the recess 73*f* of the upper case 73 illustrated in FIG. 6.

Figure 9:
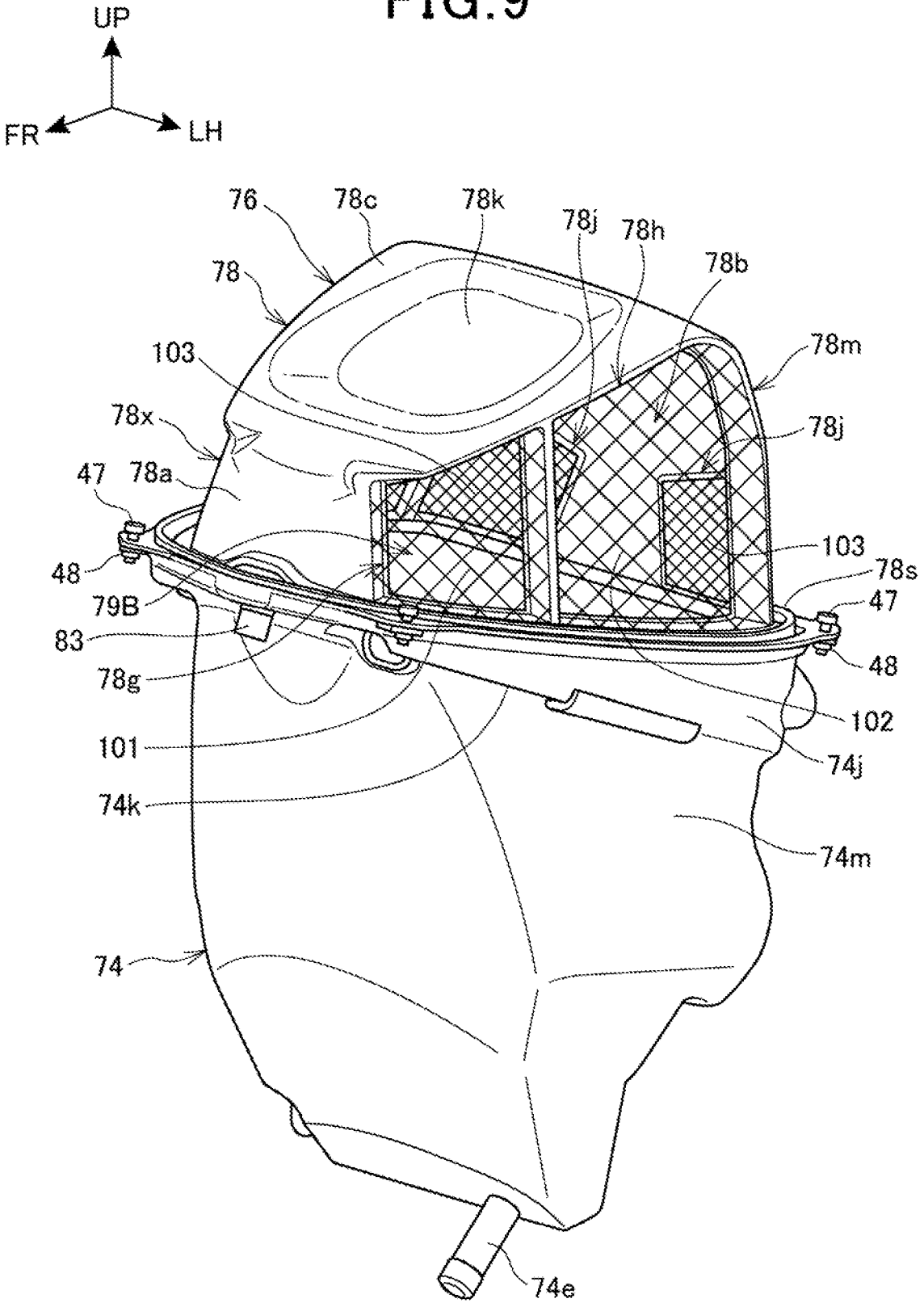
FIG. 9 is a perspective view illustrating a state where the filter element is placed on an upper edge of a lower case.

FIG. 9 is a perspective view illustrating a state where the filter element 76 is placed on the upper edge of the lower case 74.

The filter supporting member 78 of the filter element 76 forms a cup shape as a whole. A part (the right and left sidewalls 78*m* and the rear wall 78*b*) of a peripheral wall 78*x* (the peripheral wall 78*x* includes the front wall 78*a*, the right and left pair of sidewalls 78*m*, and the rear wall 78*b*) of the filter supporting member 78 has openings (the front openings 78*g*, the middle openings 78*h*, and the rear openings 78*j*). The filters (the front filters 101, the middle filters 102, and the rear filters 103) are disposed on the openings (the front openings 78*g*, the middle openings 78*h*, and the rear openings 78*j*).

Disposing the front filters 101, the middle filters 102, and the rear filters 103 on the right and left sidewalls 78*m* and the rear wall 78*b* further increases a filter area, thereby ensuring an enhanced air purifying capability of the filter and an increased purified air volume. Additionally, a volume of the clean side 79B formed of the filter element 76 and the lower case 74 can be further increased. As a result, the air volume supplied to the engine 11 (see FIG. 1) can be increased to ensure achieving an improved output of the engine 11.

Figure 10:
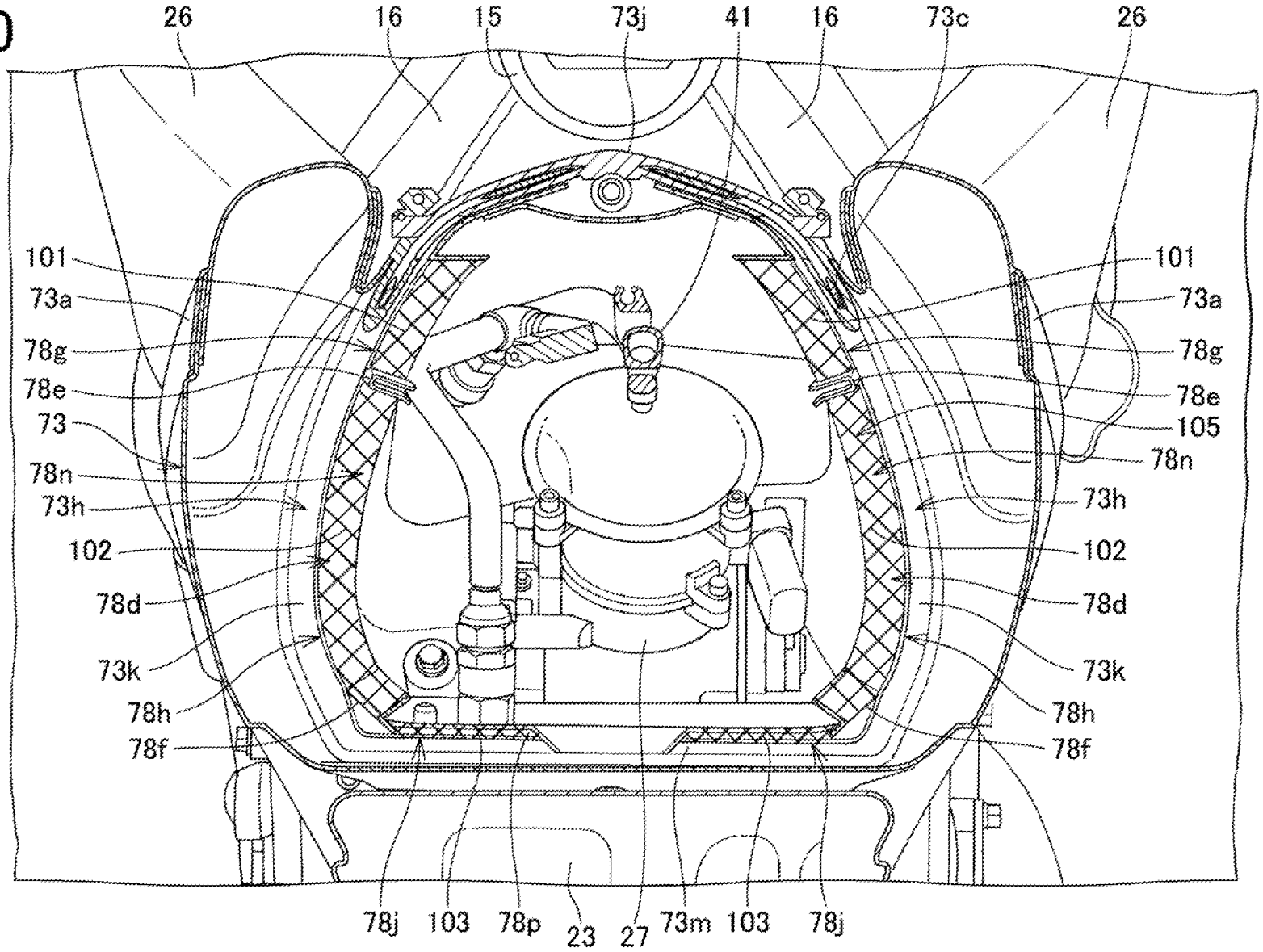
FIG. 10 is a cross-sectional view taken along a line X-X in FIG. 1.

FIG. 10 is a cross-sectional view taken along a line X-X in FIG. 1.

The right and left coupling portions 78*d* are disposed along an upper ring-shaped extruding portion 73*h* inside the upper ring-shaped extruding portion 73*h* where the upper ring groove 73*c* (see also FIG. 2) of the upper case 73 is formed.

The upper ring-shaped extruding portion 73*h* includes a front ring-shaped extruding portion 73*j*, a right and left pair of lateral ring-shaped extruding portions 73*k*, and a rear ring-shaped extruding portion 73*m*. The front ring-shaped extruding portion 73*j* is disposed in the vehicle front side. The lateral ring-shaped extruding portions 73*k* extend rearward while curving from both respective side edge portions in the vehicle width direction of the front ring-shaped extruding portion 73*j*. The rear ring-shaped extruding portion 73*m* in a straight line is coupled to the rear ends of the right and left lateral ring-shaped extruding portions 73*k*.

The right and left coupling portions 78*d* include side coupling portions 78*n* and a rear coupling portion 78*p*. The side coupling portions 78*n* are disposed along the right and left lateral ring-shaped extruding portions 73*k*. The rear coupling portion 78*p* couples rear ends of the right and left side coupling portions 78*n*.

The right and left side coupling portions 78*n* form curved shapes that extrude outward in the vehicle width direction. The respective front filters 101 are disposed on the right and left front openings 78*g*, which include the right and left side coupling portions 78*n* as a part. The right and left front filters 101 are positioned in outer sides in the vehicle width direction of the upper fuel injection device 41. That is, the right and left front filters 101 and the upper fuel injection device 41 align in the vehicle width direction. Furthermore, the suction ports 73*a* of the upper case 73 also align with the right and left front filters 101 and the upper fuel injection device 41 in the vehicle width direction.

The respective middle filters 102 are disposed on the right and left middle openings 78*h*, which include the right and left side coupling portions 78*n* as a part. In the cross-sectional view in FIG. 10, the right and left middle filters 102 are positioned in outer sides in the vehicle width direction of the throttle body 27.

The respective rear filters 103 are disposed on the right and left rear openings 78*j*, which include the rear coupling portion 78*p* as a part.

The right and left front filters 101 and middle filters 102 are disposed at positions where the right and left ducts 26 and the right and left suction ports 73*a* of the upper case 73, to which the right and left ducts 26 are coupled, are extended. In view of this, the air is likely to smoothly hit and pass the right and left front filters 101 and middle filters 102 from the right and left ducts 26.

As described above, since the sidewall filters 105 are disposed on the right and left sides of the upper fuel injection device 41, the air can be equally suctioned from the right and left sidewall filters 105, and thus, the air-intake quantity of the air-fuel mixture to the cylinder head 22*b* (see FIG. 1) can be further stably secured.

The ducts 26 that guide the air into the air cleaner 25 are coupled to the air cleaner case 75, and the sidewall filters 105 are disposed to face the suction ports 73*a* of the air cleaner case 75 to which the ducts 26 are coupled.

This configuration ensures smoothly supplying the intake air from the ducts 26 into the air cleaner case 75.

As illustrated in FIG. 2 and FIG. 10, each of the suction ports 73*a* of the air cleaner case 75, the sidewall filters 105, and the upper fuel injection device 41 has at least partially overlapping in the vehicle width direction.

This configuration causes the intake air taken into the air cleaner case 75 from the ducts 26 to easily mix with the fuel injected from the upper fuel injection device 41, and thus, the produced air-fuel mixture can be smoothly supplied to the cylinder head 22*b* (see FIG. 1).

Figure 11:
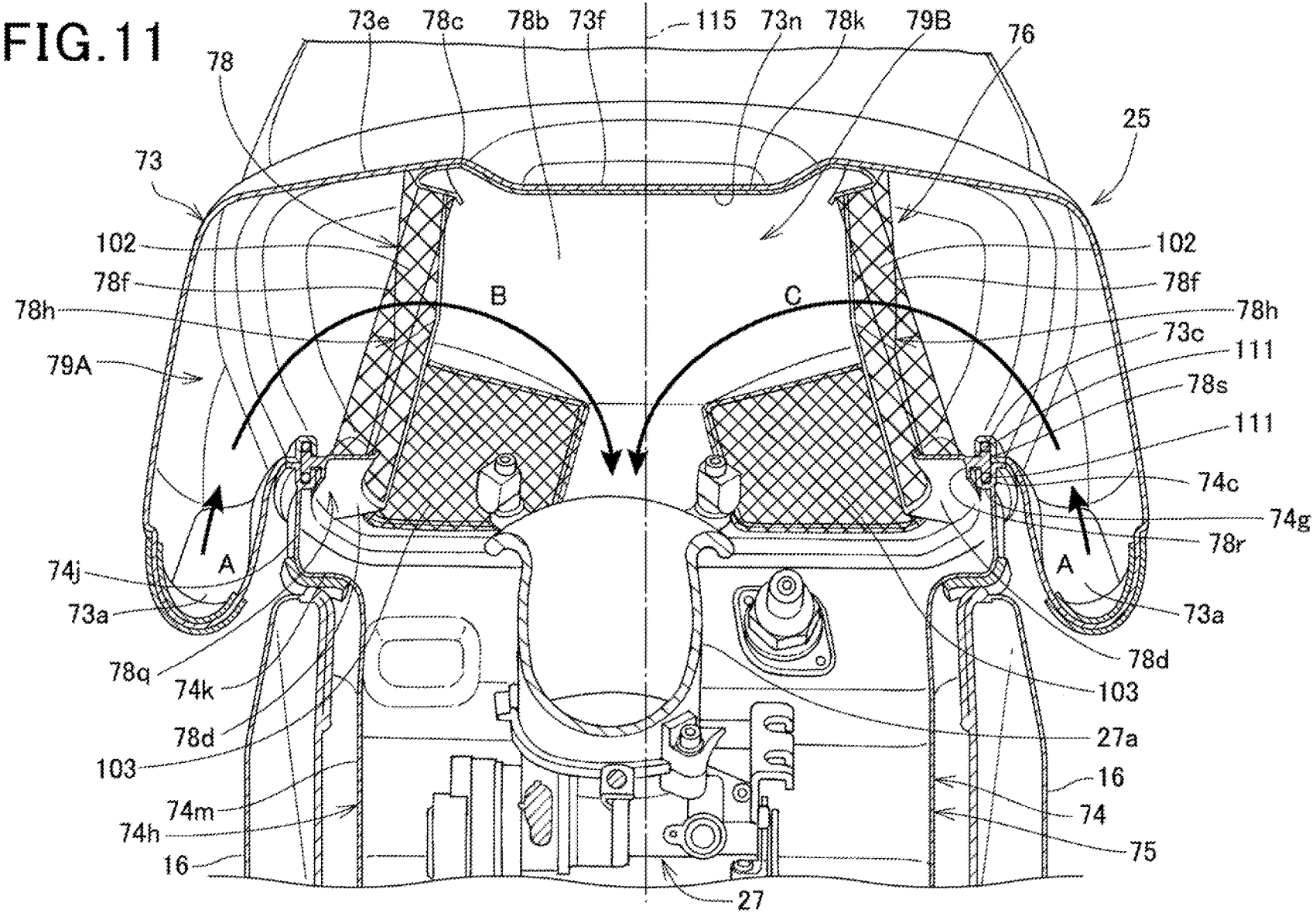
FIG. 11 is a cross-sectional view taken along a line XI-XI in FIG. 1.

FIG. 11 is a cross-sectional view taken along a line XI-XI in FIG. 1.

The right and left front filters 101 (see FIG. 10) and middle filters 102 of the filter element 76 are disposed so as to be vertically elongate at respective outer sides in the vehicle width direction with respect to a vehicle body centerline 115. Specifically, the front filters 101 and the middle filters 102 are inclinedly disposed such that upper ends are located at inner sides in the vehicle width direction with respect to respective lower ends.

This causes the air suctioned as illustrated by an arrow A from the right and left suction ports 73*a* of the upper case 73 disposed at outer sides in the vehicle width direction of the air suction port 27*a* of the throttle body 27 to be suctioned making a smooth curve as illustrated by arrows B and C from the air suction port 27*a* of the throttle body 27 disposed underneath the filter element 76. The airflow in this case approximately orthogonally passes through the front filters 101 and the middle filters 102.

The above-described disposition of the front filters 101 and the middle filters 102 can easily ensure the air volume suctioned into the throttle body 27.

A peripheral edge portion 78*q* that constitutes the lower portion of the filter supporting member 78 includes the front wall 78*a* (see FIG. 10), a ring-shaped lower peripheral wall 78*r* that projects downward from the rear wall 78*b* and the right and left coupling portions 78*d*, and a ring-shaped fitting portion 78*s* having a laterally facing T shaped cross-sectional surface. The ring-shaped fitting portion 78*s* is formed at an outer peripheral surface of the ring-shaped lower peripheral wall 78*r*.

The ring-shaped lower peripheral wall 78*r* is disposed so as to run along inside a lower ring-shaped extruding portion 74*g* on which the lower ring groove 74*c* of the lower case 74 is formed.

The ring-shaped fitting portion 78*s* is fitted to the upper ring groove 73*c* of the upper case 73 and the lower ring groove 74*c* of the lower case 74. In the upper ring groove 73*c* and the lower ring groove 74*c*, respective ring-shaped sealing members 111 are disposed. Between the ring-shaped fitting portion 78*s* and a groove bottom of the upper ring groove 73*c* and between the ring-shaped fitting portion 78*s* and a groove bottom of the lower ring groove 74*c* are sealed with the respective sealing members 111.

The above-described ring-shaped fitting portion 78*s* is a securing portion for the filter element 76 to the air cleaner case 75.

The recess 73*f* (specifically, an extruding portion 73*n* provided on a lower surface side of the recess 73*f* of the upper case 73) of the upper case 73 is caused to abut on or be adjacent to the filter side recess 78*k* of the filter supporting member 78. That is, the extruding portion 73*n* of the upper case 73 fits to the filter side recess 78*k* of the filter supporting member 78.

This supports the upper wall 78*c* of the filter element 76 (specifically, the filter supporting member 78) having a height equal to a lateral width (for example, lateral width of the upper wall 78*c*) with the upper wall 73*e* of the upper case 73. In view of this, the upper case 73 can reduce vibration of the filter element 76 in front to back and side to side directions in association with the vehicle body vibration. Furthermore, the filter supporting member 78 fitting to the upper case 73 ensures enhanced rigidity of the upper portion of the air cleaner 25, and additionally, it is possible to ensure a weight reduction by thinning wall thicknesses of the upper case 73 and the filter supporting member 78.

Right and left sidewalls 74*h* of the lower case 74 include right and left upper side walls 74*j*, right and left step portions 74*k*, and lower side walls 74*m*. The right and left upper side walls 74*j* extend downward from the lower ring-shaped extruding portion 74*g*. The right and left step portions 74*k* extend inward in the vehicle width direction respective lower edges of the right and left upper side walls 74*j*. The lower side walls 74*m* extend downward from inner edges of the right and left step portions 74*k*.

The right and left lower side walls 74*m* are disposed inner sides in the vehicle width direction of the right and left main frames 16. The right and left upper side walls 74*j* have widths in the vehicle width direction wider than widths in the vehicle width direction of the right and left lower side walls 74*m*; therefore, the width in the vehicle width direction of the lower end opening of the filter element 76 can be widened, and eventually, an area of the lower end opening of the filter element 76 can be further widened. Accordingly, the volume of the clean side 79B of the air cleaner 25 can be increased, thereby ensuring a contribution to an increased suctioned air volume.

As illustrated in FIG. 1, FIG. 2, and FIG. 10 described above, the intake device 24 of the motorcycle 10 has the air cleaner 25 inside which the upper fuel injection device 41 as a fuel injection device injecting fuel and the air suction ports 27*a* suctioning the air-fuel mixture supplied to the cylinder head 22*b* are disposed. In the intake device 24, the air cleaner 25 includes the air cleaner case 75 and the sidewall filters 105 as a filter purifying the air suctioned into the air cleaner case 75.

The sidewall filters 105 partition the space in the vehicle width direction inside the air cleaner case 75 and have at least partially overlapping with the upper fuel injection device 41 in the vehicle width direction.

This configuration ensures widely forming an upper space of the upper fuel injection device 41 in this embodiment compared with the conventional configuration in which the filters are disposed in an upper side of the fuel injection device so as to divide the space in the air cleaner into an upper side and a lower side. This ensures stably securing the air-intake quantity of the air-fuel mixture to the cylinder head 22*b* and disposing the sidewall filter 105 at the proximity of the upper fuel injection device 41. In view of this, the air-fuel mixture flow of the fuel injected from the upper fuel injection device 41 and the air can be smoothly formed, and the downsized air cleaner case 75 can be ensured.

As illustrated in FIG. 10 and FIG. 11, the sidewall filters 105 are disposed on the right and left sides of the upper fuel injection device 41 and the recess 73*f* is disposed on the upper wall 73*e* of the air cleaner case 75 and at an inner side in the vehicle width direction with respect to the right and left pair of sidewall filters 105.

This configuration ensures a reduced air resistance, for example, by the occupant putting his/her head in the recess 73*f* during travelling, without narrowing the upper space of the upper fuel injection device 41 in this embodiment compared with the conventional configuration in which the filters are disposed in the upper side of the fuel injection device so as to divide the air cleaner 25 into an upper side and a lower side.

As described in FIG. 2 and FIG. 11, the filter supporting member 78 holding the sidewall filters 105 has the filter side recess 78*k* formed into a shape that runs along the recess 73*f* of the air cleaner case 75.

This configuration ensures forming a wide space in the air cleaner case 75 by forming the filter side recess 78*k* into a shape running along the recess 73*f* of the air cleaner case 75. Furthermore, causing the filter side recess 78*k* to abut on the recess 73*f* of the air cleaner case 75 ensures contributions to an improved strength and a reduced vibration of the upper portion of the air cleaner case 75.

As illustrated in FIG. 7 and FIG. 11, the sidewall filters 105 are inclinedly disposed such that the upper ends are located at the inner sides with respect to the lower ends.

This configuration ensures smoothly supplying the intake air from the sidewall filters 105 to the proximity of the upper fuel injection device 41, thereby ensuring further smoothly forming the air-fuel mixture flow of the fuel and the intake air injected from the upper fuel injection device 41.

The above-described embodiment is given to merely illustrate an aspect of the present invention, and any modification and application are possible without departing from the spirit of the present invention.

For example, in the above-described embodiment, the middle filters 102 illustrated in FIG. 2 may overlap in the vehicle width direction with the fuel injection device in the vehicle width direction.

Not limited to the application to the motorcycle 10, the present invention is applicable to a saddle riding vehicle including a vehicle other than the motorcycle 10. The saddle riding vehicle includes a general vehicle that is ridden by straddling the vehicle body. The saddle riding vehicle includes not only a motorcycle (including motorized bicycle) but also a three-wheeled vehicle and a four-wheeled vehicle classified as ATV (All Terrain Vehicle).

REFERENCE SIGNS LIST

10 . . . Motorcycle (saddle riding vehicle)
24 . . . Intake device
25 . . . Air cleaner
26 . . . Duct
41 . . . Upper fuel injection device (fuel injection device)
73*a* . . . Suction port
73*e* . . . Upper wall
73*f* . . . Recess
75 . . . Air cleaner case
78*k* . . . Filter side recess
105 . . . Sidewall filter (filter)

The invention claimed is:

1. An intake device for a saddle riding vehicle comprising:
a fuel injection device that injects a fuel; and
a suction port that suctions an air-fuel mixture supplied to a cylinder head;
wherein the fuel infection device and the suction port are disposed in an air cleaner, the air cleaner further comprising an air cleaner case and right and left filters that purify air suctioned into the air cleaner case and that are disposed at right and left sides of the fuel injection device, respectively;
wherein each of the right and left filters partitions a space in the air cleaner case in a vehicle width direction, and is at least partially overlapping with the fuel injection device in the vehicle width direction; and,
wherein the air cleaner case has an upper wall on which a recess is disposed at an inner side in the vehicle width direction with respect to the right and left filters.

2. The intake device for the saddle riding vehicle according to claim 1,
wherein the right and left filters disposed in a range equal to or more than a length of the fuel injection device in a vehicle front-rear direction.

3. The intake device for the saddle riding vehicle according to claim 2,
wherein right and left filters are is disposed in a range equal to or more than a distance from the suction port to an injection hole of the fuel injection device in the vehicle front-rear direction.

4. The intake device for the saddle riding vehicle according to claim 2,
wherein each of right and left filters is inclinedly disposed such that an upper end is located at an inner side in the vehicle width direction with respect to a lower end.

5. The intake device for the saddle riding vehicle according to claim 2,
wherein a duct is coupled to the air cleaner case and guides air into the air cleaner, and the right and left filters are is disposed to face a suction port of the air cleaner case to which the duct is coupled.

6. The intake device for the saddle riding vehicle according to claim 1,
wherein the right and left filters are disposed in a range equal to or more than a distance from the suction port to an injection hole of the fuel injection device in the vehicle front-rear direction.

7. The intake device for the saddle riding vehicle according to claim 6,
wherein each of right and left filters is inclinedly disposed such that an upper end is located at an inner side in the vehicle width direction with respect to a lower end.

8. The intake device for the saddle riding vehicle according to claim 6,
wherein a duct is coupled to the air cleaner case and guides air into the air cleaner, and the right and left filters are disposed to face a suction port of the air cleaner case to which the duct is coupled.

9. The intake device for the saddle riding vehicle according to claim 1,
wherein each of the right and left filters is inclinedly disposed such that an upper end is located at an inner side in the vehicle width direction with respect to a lower end.

10. The intake device for the saddle riding vehicle according to claim 9,
wherein a duct is coupled to the air cleaner case and guides air into the air cleaner, and the right and left filters are is disposed to face a suction port of the air cleaner case to which the duct is coupled.

11. The intake device for the saddle riding vehicle according to claim 1,
wherein a duct is coupled to the air cleaner case and guides air into the air cleaner, and the right and left filters are disposed to face a suction port of the air cleaner case to which the duct is coupled.

12. The intake device for the saddle riding vehicle according to claim 11,
wherein the suction port of the air cleaner case, the right and left filters, and the fuel injection device are at least partially overlapping in the vehicle width direction.

13. The intake device for the saddle riding vehicle according to claim 1, wherein the right and left filters are held by a filter holding member that has a filter side recess formed into a shape that runs along the recess of the air cleaner case.

14. The intake device for the saddle riding vehicle according to claim 1, wherein each of the right and left filters comprises a front side filter and a rear side filter, said rear side filter being arranged at a rear of the front side filter, wherein the suction port of the air cleaner case, the front side filter, and the fuel injection device overlap in side view, the right and left filters are held by a filter holding member that includes a front wall, a rear wall and an upper wall, a part of a peripheral wall of the filter holding member has openings, the peripheral wall comprising the front wall, the rear wall and the upper wall, and the right and left filters are disposed on the openings.

15. The intake device for the saddle riding vehicle according to claim 14, wherein the filter holding member includes a right sidewall and a left sidewall.

16. The intake device for the saddle riding vehicle according to claim 15, wherein a duct is coupled to the air cleaner case and guides air into the air cleaner, the duct is disposed at an outer side in the vehicle width direction with respect to the right and left filters, the right and left filters are disposed on the right and left sidewalls, respectively, that partition the space in the air cleaner case in the vehicle width direction, a rear filter is provided on a part of the rear wall, and a position of an upper end of the right and left filters is higher than a position of an upper end of the rear filter.

* * * * *